US006863770B2

(12) United States Patent
Jae et al.

(10) Patent No.: US 6,863,770 B2
(45) Date of Patent: Mar. 8, 2005

(54) METHOD AND APPARATUS FOR POLISHING A SUBSTRATE WHILE WASHING A POLISHING PAD OF THE APPARATUS WITH AT LEAST ONE FREE-FLOWING VERTICAL STREAM OF LIQUID

(75) Inventors: Man-Ho Jae, Suwon-si (JP); Min-Gyu Kim, Suwon-si (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 319 days.

(21) Appl. No.: 10/087,855

(22) Filed: Mar. 5, 2002

(65) Prior Publication Data

US 2002/0177320 A1 Nov. 28, 2002

(30) Foreign Application Priority Data

Mar. 26, 2001 (KR) ..... 2001-15655

(51) Int. Cl.[7] ..... C23F 1/00; H01L 21/306

(52) U.S. Cl. ..... 156/345.12

(58) Field of Search ..... 156/345.12, 345.17, 156/345.18, 345.21; 134/113

(56) References Cited

U.S. PATENT DOCUMENTS 5,709,593 A 1/1998 Guthrie et al.
6,051,499 A 4/2000 Tolles et al.
6,431,184 B1 * 8/2002 Taniyama ..... 134/1.3
6,669,538 B2 * 12/2003 Li et al. ..... 451/56
6,722,943 B2 * 4/2004 Joslyn ..... 451/5
6,736,926 B2 * 5/2004 Chopra et al. ..... 156/345.13

FOREIGN PATENT DOCUMENTS

JP 5-343375 12/1993

* cited by examiner

*Primary Examiner*—P. Hassanzadeh
*Assistant Examiner*—Roberts Culbert
(74) *Attorney, Agent, or Firm*—Volentine Francos & Whitt P.L.L.C.

(57) ABSTRACT

A method and apparatus for polishing a substrate with a polishing pad and slurry entails washing polishing-pollutants produced by the polishing operation off of the pad in such a way that the pollutants are not splashed onto components of the polishing apparatus. A washing solution for removing the pollutants is directed onto the polishing pad as at least one free-flowing vertical stream. Because the washing solution flows freely and vertically as it impinges the polishing pad, the washing solution does not rebound from the pad and flows from the surface of the polishing pad without causing the pollutants on the pad to be splashed up from the surface of the pad.

13 Claims, 9 Drawing Sheets

METHOD AND APPARATUS FOR POLISHING A SUBSTRATE WHILE WASHING A POLISHING PAD OF THE APPARATUS WITH AT LEAST ONE FREE-FLOWING VERTICAL STREAM OF LIQUID

BACKGROUND OF THE INVENTION

1. Field of the Invention

The present invention relates to a method and an apparatus for polishing a substrate using a polishing pad and slurry. More particularly, the present invention relates to the washing of the polishing pad to remove slurry and other particles therefrom.

2. Description of the Related Art

Recently, the semiconductor industry has made great strides as the use of information media including computers has increased. As concerns its function, a semiconductor device must operate at a high speed and have a large data storage capacity. Accordingly, improvements in semiconductor manufacturing techniques have centered around increasing the degree of integration, reliance and response speed of semiconductor devices.

Chemical mechanical polishing (CMP) was developed in the 1980s for increasing the degree of integration of semiconductor devices. CMP is a manufacturing technique for polishing a surface on a substrate to attain a high degree of surface flatness. Examples of CMP polishing technologies are disclosed in U.S. Pat. No. 5,709,593 issued to Guthrie et al., and in U.S. Pat. No. 6,051,499 issued to Tolles et al. FIG. 1 illustrates the polishing of a surface on a substrate 10 using a conventional a polishing apparatus.

Referring to FIG. 1, the substrate 10 is grasped by a carrier head 12 which can simultaneously rotate and oscillate. The substrate 10 is pressed by the carrier head 12 against a rotatable polishing pad 14 mounted on a platen 13. In this state, the substrate 10 is polished by slurry 16 which is sprayed onto the polishing pad 14. More specifically, the substrate 10 is polished mechanically by an abrasive component of the slurry 16 and the abrasive surface of polishing pad 14, and the substrate 10 is polished chemically by a chemical component the slurry 16.

In this polishing process, particles generated by the polishing process and some of the slurry remain on the polishing pad 14. If these particles and slurry were to remain on the polishing pad, they could cause a defect to occur on a substrate as it is being polished. Therefore, the particles and slurry are removed from the polishing pad 14 while the substrate 10 is being polished.

FIG. 2 shows a washing device 20 for washing a polishing pad 14 of the conventional polishing apparatus. Referring to FIG. 2, the washing device 20 includes an arm, and nozzles 21, 22, 23, 24, 25 mounted to the arm to spray deionized water 30 onto the polishing pad 14. A slurry dispenser 40, which supplies slurry 32 onto the polishing pad 22, is also mounted to the arm of the washing device 20. The outlet 34 of the slurry dispenser 40 is located at the end of the arm of the washing device 20.

Other conventional slurry dispensers, similar to that described above, are known. For example, a slurry dispenser disclosed in U.S. Pat. No. 5,928,062, issued to Miller et al., includes several slurry outlets through which the slurry flows. The several slurry outlets each are in the form of a nozzle or a hole. The nozzles function to spray the slurry, whereas the holes function to drip the slurry. Another slurry dispenser, disclosed in Japanese Patent Laid-open No. Hei 5-343375, is mounted on the polishing pad itself.

In any case, during the polishing operation, the washing device 20 sprays deionized water 30 through the nozzles 21, 22, 23, 24, 25 and onto the polishing pad 14 to remove particles and slurry from the polishing pad 14. Specifically, the sprayed deionized water 30 flows from polishing pad 14 carrying the remaining particles and slurry with it and hence, the particles and slurry are removed. In addition to removing particles and slurry during the polishing operation, the washing device 20 serves to clean the polishing pad 14 by supplying deionized water 30 onto the polishing pad 14 after the polishing of substrate has been completed.

FIG. 3 is a cross-sectional view of the washing device 20 shown in FIG. 2. Referring to FIG. 3, the deionized water 30 sprayed onto the polishing pad 14 rebounds from the surface of polishing pad 14 due to the pressure under which the deionized water 30 is sprayed. Moreover, the slurry 30*a* remaining on the polishing pad 14 also flies off of the polishing pad 14 together with the deionized water. The slurry 30*a* adheres to the washing device 20 itself and to other components of the polishing apparatus, whereupon the slurry 30*a* accumulates on the washing device 20 and on other components of the polishing apparatus. Such slurry 30*a* causes a defect to occur on a substrate during the polishing process. That is, it is difficult to clean the slurry, especially from the components of the polishing apparatus. Eventually, clumped particles of the slurry begin to continuously fall from the components of the polishing apparatus onto the surface of the polishing pad 14. There, the slurry particles scratch the surface of the substrate during the polishing process.

In a short, the slurry entrained by the deionized water rebounding from the polishing pad is a constant source of defects during the polishing process. These defects, which occur on the substrates, decrease the reliability of the semiconductor devices manufactured therefrom.

SUMMARY OF THE INVENTION

The present invention has been developed in view of the above-mentioned problems of the prior art. Accordingly it is a first object of present invention to provide a method of polishing a substrate which can minimize the rebounding of washing liquid from the polishing pad. Likewise, it is a second object of the present invention to provide an apparatus for polishing a substrate which can dispense a washing solution onto a polishing pad during the polishing operation in such a way as to minimize the rebounding of the washing liquid from the polishing pad.

To achieve the first object of the present invention, the method of polishing a substrate comprises steps of rotating a substrate, rotating a polishing pad, polishing a surface of the substrate by placing the substrate in contact with the polishing pad and supplying slurry onto the polishing pad, and eliminating polishing-pollutants produced as a result of the polishing of the substrate by directing washing solution onto the polishing pad in the form of at least one free-flowing vertical stream to prevent the washing liquid from rebounding from the polishing pad.

Preferably, the washing liquid is deionized water, and is directed onto the upper surface of the polishing pad as a number of free-flowing vertical streams, spaced at equal intervals from one another.

To achieve the second object of the present invention, the polishing apparatus comprises a polishing station, a polishing pad mounted to the polishing station for contacting a substrate to polish the substrate, and a washing device located at one side of the polishing pad and having at least one feed hole through washing liquid flows freely onto the polishing pad as a vertically stream to eliminate polishing-pollutants from the polishing pad.

According to the present invention, because the washing liquid flows vertically and freely onto the polishing pad, the washing liquid is prevented from rebounding. Therefore, the splashing of the slurry due to the rebounding of the washing liquid is also be minimized. As a result, slurry is prevented from accumulating on components of the polishing apparatus including on the washing device. Hence, defects in the polishing process, which are otherwise caused by agglomerations of slurry falling off of components of the polishing apparatus and onto the polishing pad during the polishing operation, are prevented.

BRIEF DESCRIPTION OF THE DRAWINGS

The above and other objects and advantages of the present invention will become readily apparent from the following detailed description thereof made with reference to the accompanying drawings wherein.

DETAILED DESCRIPTION OF THE PREFERRED EMBODIMENT

Hereinafter, preferred embodiments of the present invention will be described in detail with reference to the attached drawings.

Figure 1:
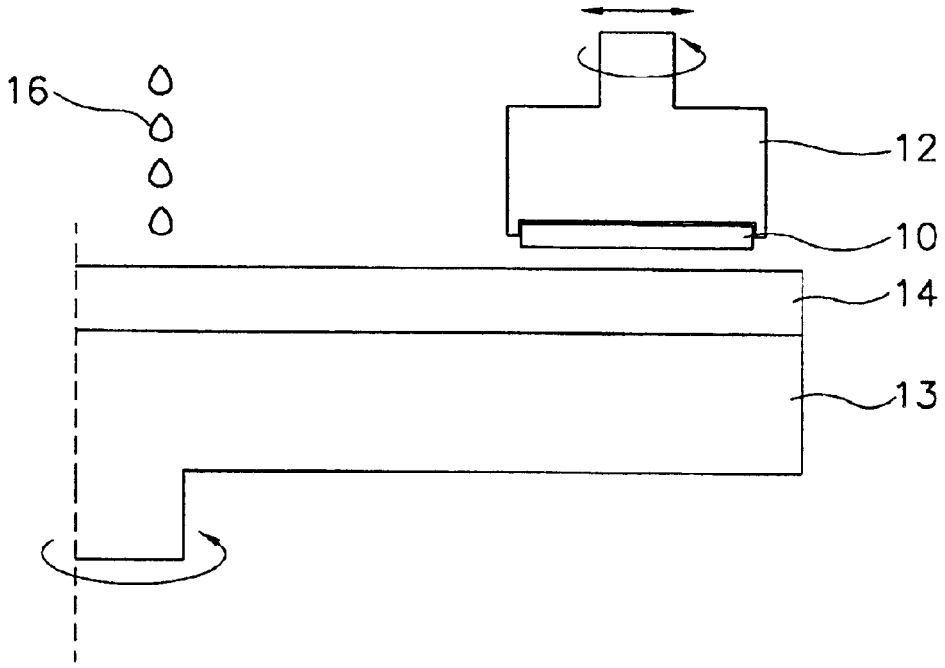
FIG. 1 (PRIOR ART)
FIG. 1 is a schematic diagram of a conventional CMP apparatus, showing a state wherein the surface of a substrate is polished.
Figure 2:
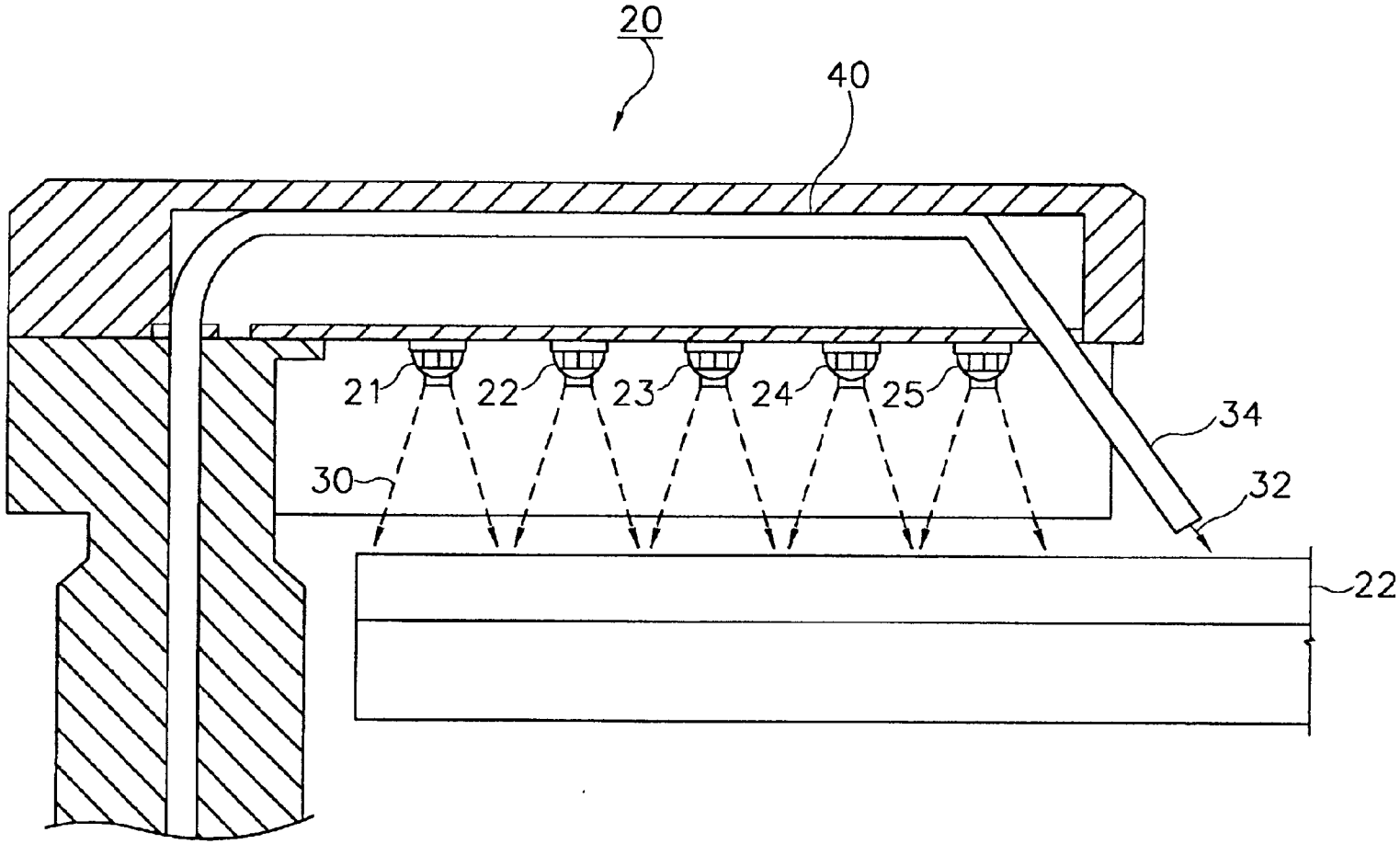
FIG. 2 (PRIOR ART)
FIG. 2 is a vertical sectional view of a washing device of the conventional polishing apparatus.
Figure 3:
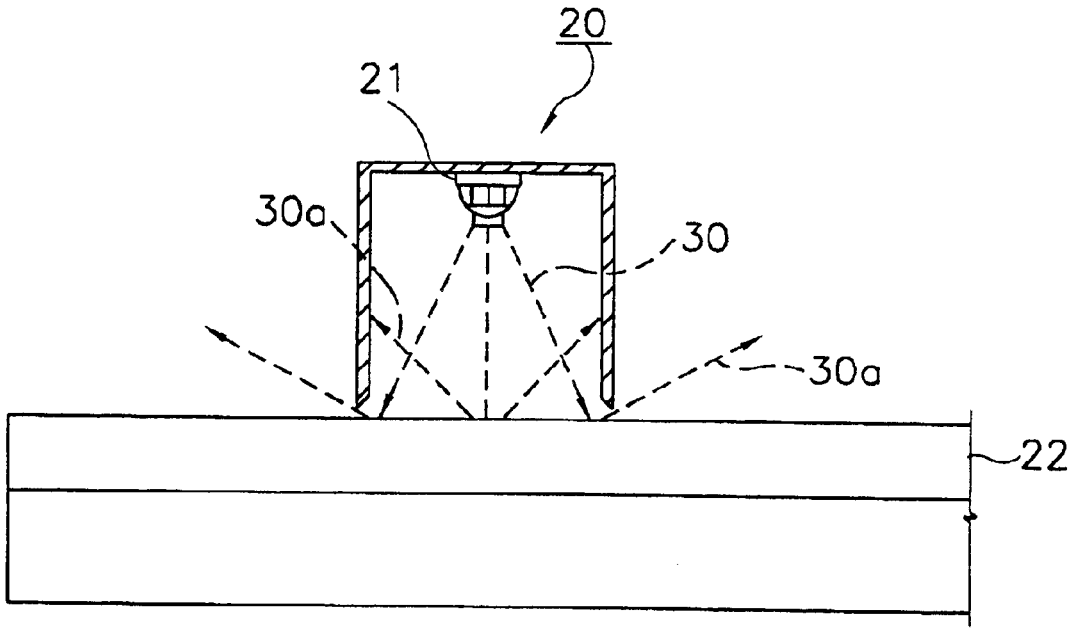
FIG. 3 (PRIOR ART)
FIG. 3 is a cross-sectional view of the washing device shown in FIG. 2.
Figure 4:
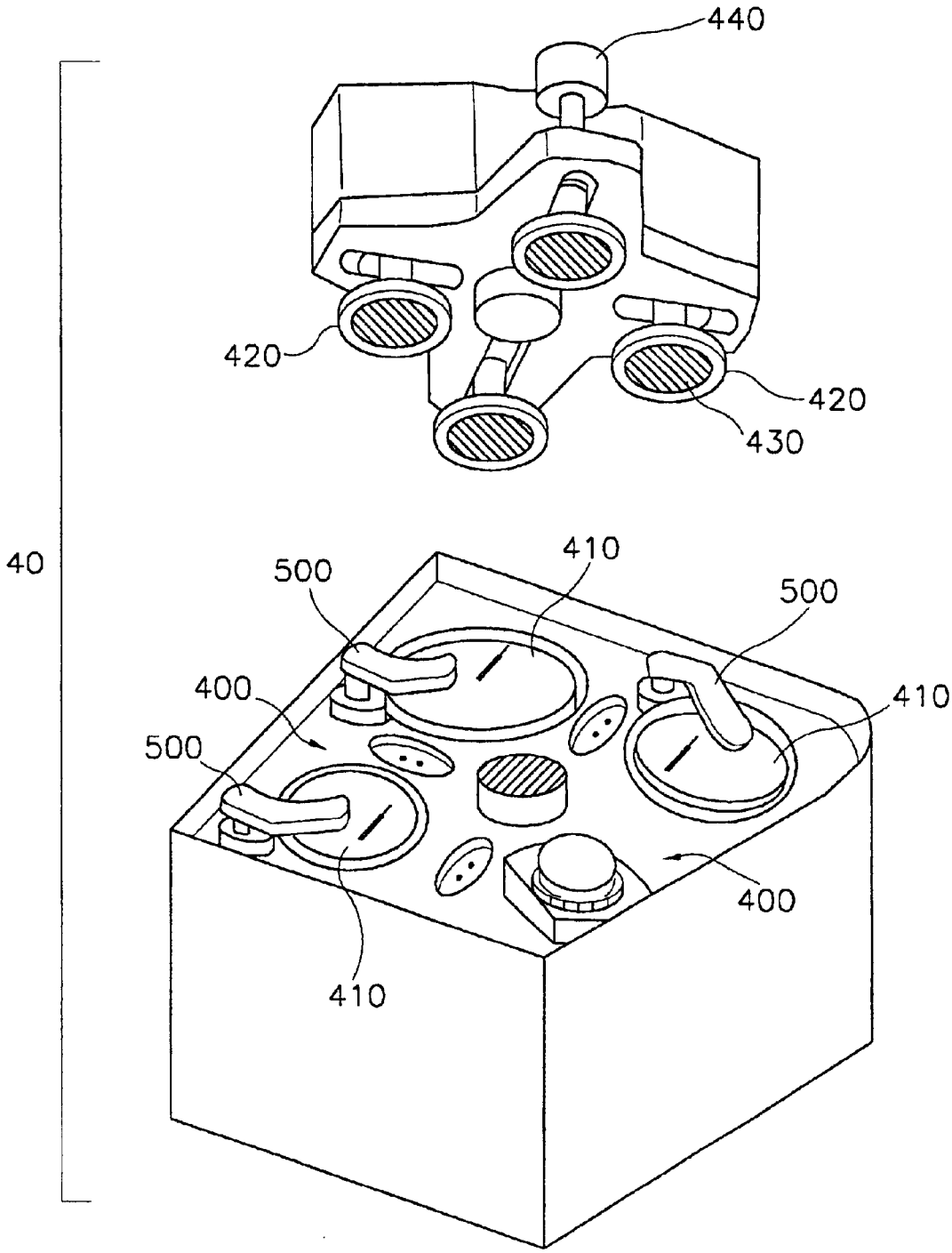
FIG. 4 is a perspective view of an apparatus for polishing a substrate according to the present invention.

Referring to FIG. 4, an apparatus 40 for polishing a substrate includes a polishing station 400 at which a plurality of polishing pads 410 are disposed, and a carrier supporting a plurality of carrier heads 420. Each carrier head 420 presses a substrate 430 against a polishing pad 410 whereupon a surface of the substrate 430 is polished.

Figure 5:
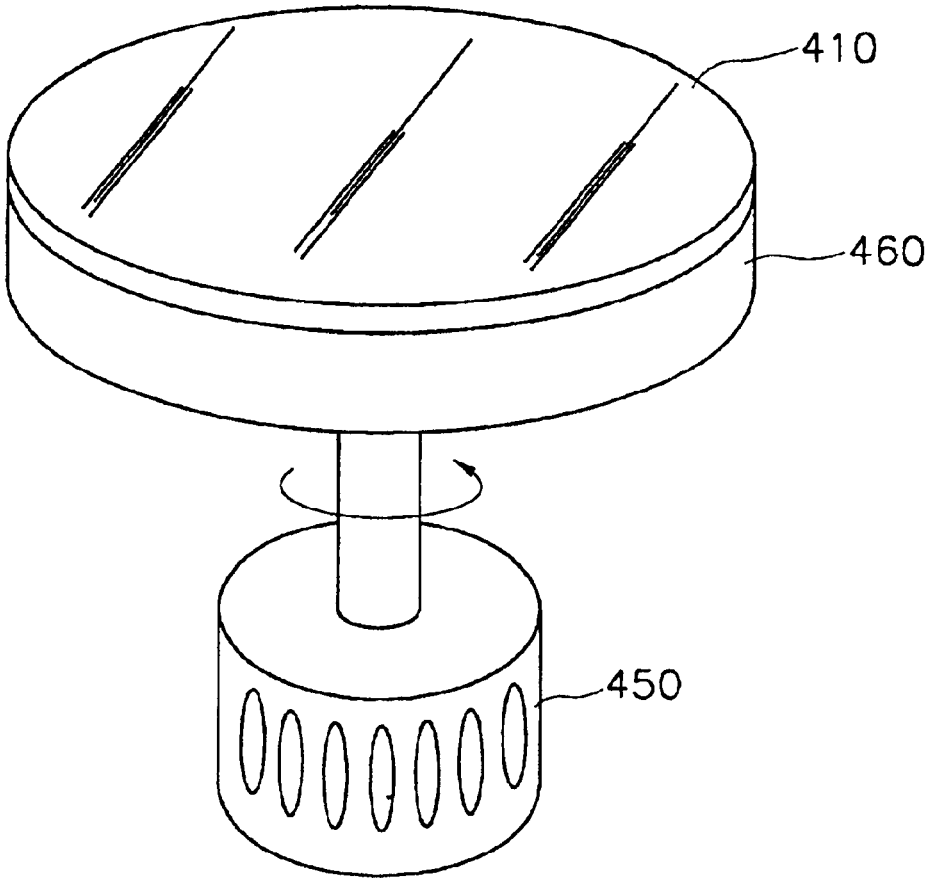
FIG. 5 is a perspective view of a polishing pad of the apparatus shown in FIG. 4.

More specifically, referring to FIG. 5, the polishing pad 410 is mounted on platen 460 connected to a rotary member 450. The rotary member 450 comprises a motor for rotating the polishing pad 410. That is, the polishing pad 410 is rotated while the surface of the substrate 430 is polished.

The carrier head 420 includes a vacuum chuck that grasps the substrate 430 by creating a vacuum at a side of the substrate opposite that which is to be polished. While the substrate 430 is so grasped, the carrier head 420 is moved downwardly to lower the substrate 430 into contact with the polishing pad 410. As the surface of the substrate 430 is being polished, the carrier head 420 rotates and oscillates to the left and right. To this end, the carrier head 420 is connected to a rotary member 440.

Once the surface of polishing pad 410 becomes worn, the polishing pad 410 can damage the substrate 430 because the polishing pad 410 contacts the substrate 430. Therefore, the apparatus 40 for polishing a substrate also includes a pad conditioning (not shown) unit that can dress the surface of the polishing pad 410 during the polishing process.

Figure 6:
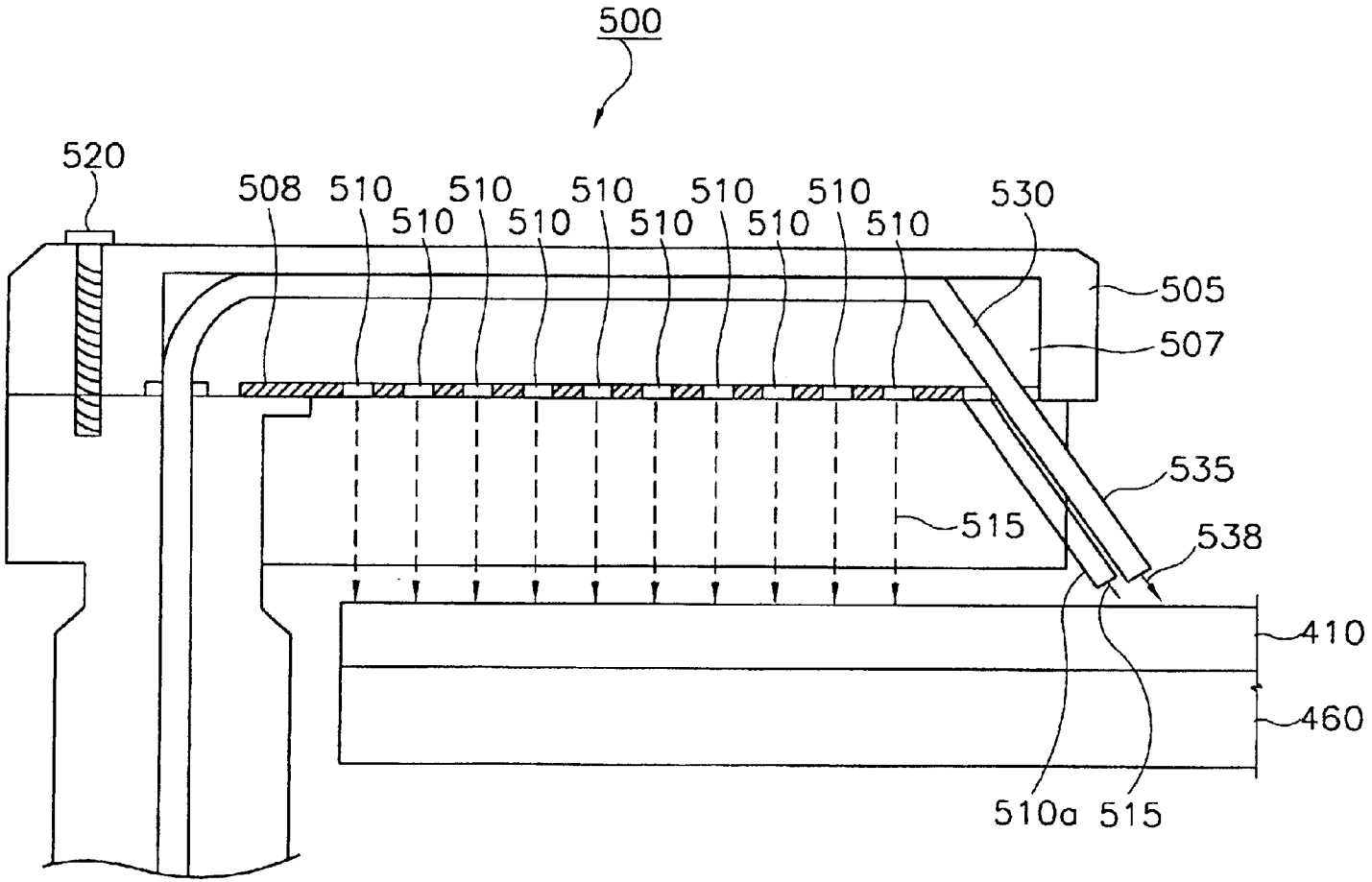
FIG. 6 is a vertical sectional view of a washing device of the apparatus for polishing a substrate according to the present invention.
Figure 7:
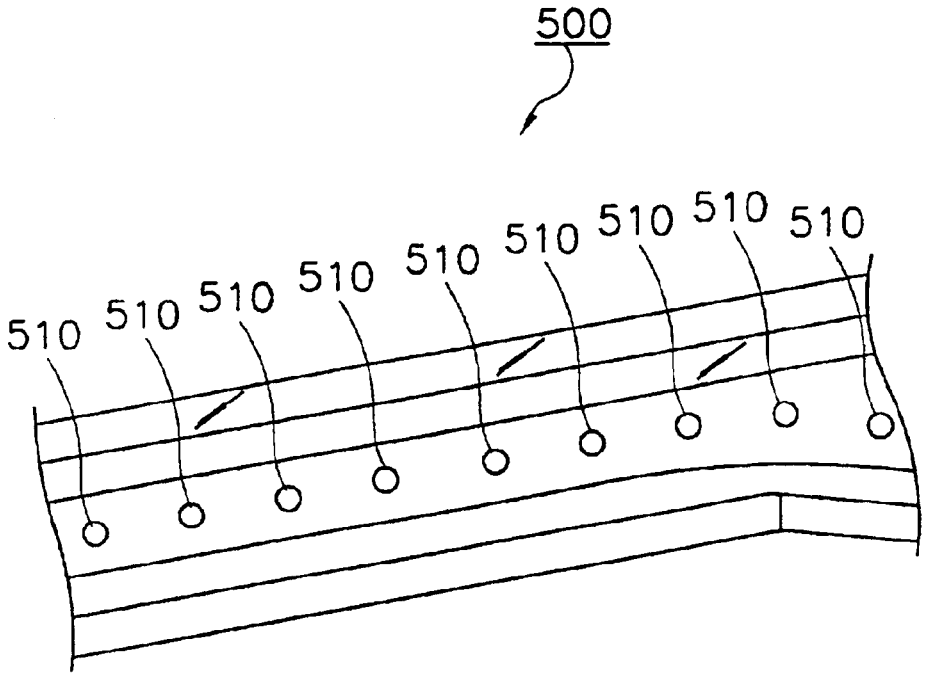
FIG. 7 is a horizontal sectional view of part of the washing device shown in FIG. 6.

The apparatus 40 for polishing a substrate also includes a washing device 500 for washing the polishing pad 410 with washing liquid while the substrate 430 is being polished. Referring to FIG. 6 and FIG. 7, the washing device 500 includes an arm 505 defining a cavity therein, and a plate 508 mounted in the cavity of the arm 505 so as to define a chamber 507 therewith. Deionized water can be supplied into the chamber 507 via a washing liquid supply line. The plate 508 has several feeding holes 510 therethrough to supply deionized water 515 onto the polishing pad 410. In the preferred embodiment, the washing device 500 has more than six feeding holes 510 and preferably, has more than ten feeding holes 510 to ensure that the deionized water 515 is supplied onto the polishing pad 410 uniformly. The diameter of each of the feeding holes 510 is about 2 mm. A washing liquid outlet tube 510*a* is also provided as extending from one of the holes 510 to supply deionized water 515 onto the polishing pad 410 at a distal end of the washing device 500. Therefore, the deionized water 515 will flow to the center of the polishing pad 410.

In addition, the arm 505 of the washing device 500 is fixed to a post of the polishing station 400 by a screw 520. Accordingly, the washing device 500 can be easily attached to and detached from the polishing station 400, and the height of the washing device 500 is adjustable. The screw 520 makes repairing the washing device 500 easy because it can be detached with ease from the polishing station 400. In an actual case, the time it took to repair the washing device was less than 30 minutes, compared to a repair time of more than 1 hour for repairing the washing device of the prior art.

As was described earlier, particles generated by the polishing process and slurry used during the polishing process have to be removed. The washing device 500 supplies deionized water 515 onto the polishing pad 410 through the feeding holes 510 during the polishing process to remove the particles and slurry. That is, the deionized water 515 flows from the polishing pad 410 carrying the particles and slurry along with it. The deionized water 515 can also flow readily from the points on the polishing pad 410 where the deionized water 515 is supplied because the washing device 500 is positioned more than 20 mm above the surface of the polishing pad 410.

Figure 8:
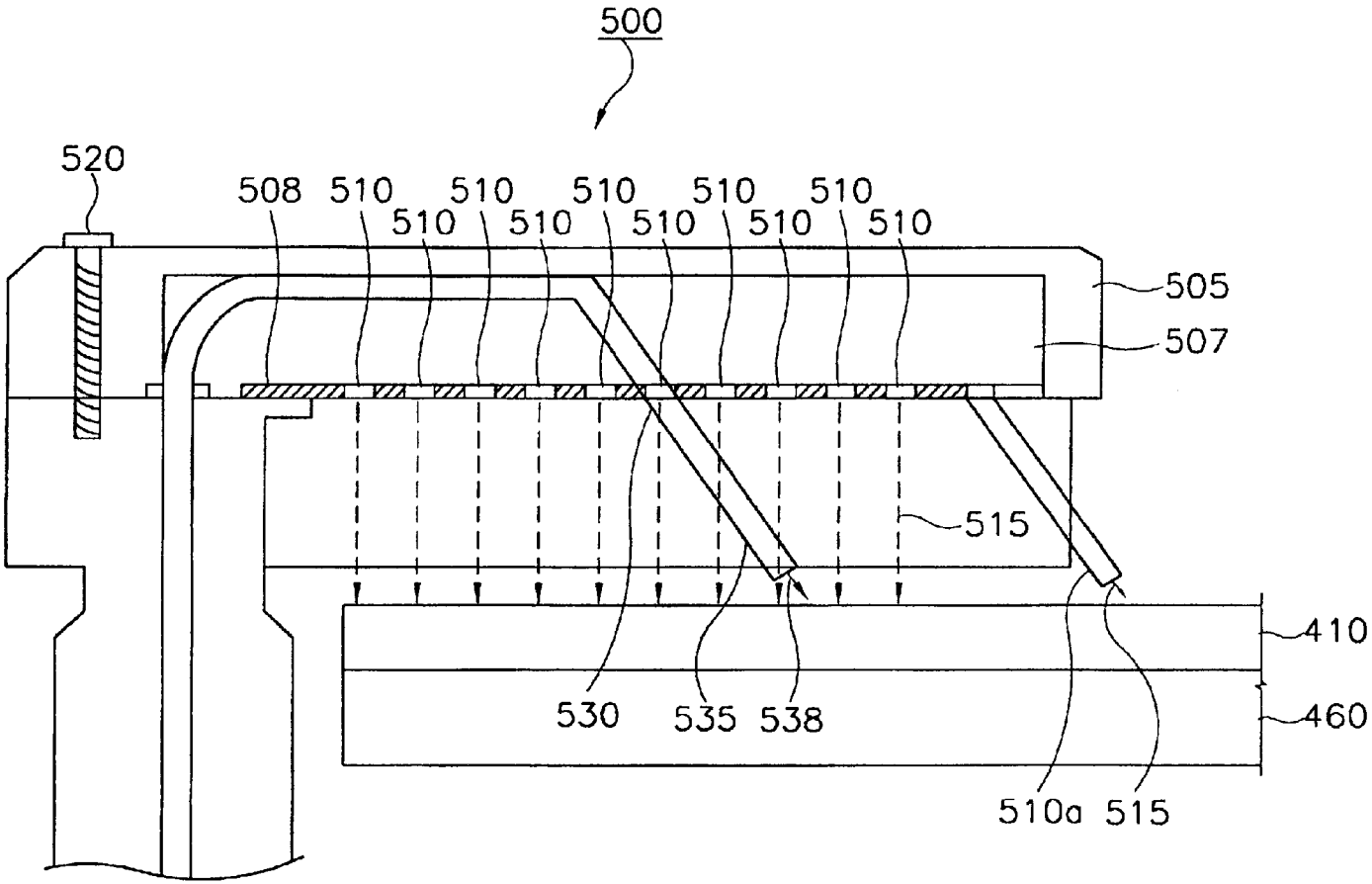
FIG. 8 is another vertical sectional view of a washing device according to the present invention.

The apparatus 40 for polishing a substrate also includes a slurry dispenser 530 which supplies the slurry 538 onto the polishing pad 410. The slurry dispenser 530 is installed in the arm 505 of the washing device 500. A slurry outlet 535 of the slurry dispenser 530 is located at the distal end of the washing device 500. The slurry dispenser 530 can include several slurry outlets 538. Referring to FIG. 8, a slurry outlet 535 can be located closer to the outer edge of the platen 460 so that the slurry is supplied to various points on the surface of the polishing pad 410. By positioning the outlet of the slurry dispenser away from the center of the polishing pad 410, the washing efficiency is improved and as a result., the polishing efficiency is improved as well.

A method of polishing a substrate using the apparatus 40 will now be described.

First, the carrier head 420 carrying the substrate 430 is rotated and then the polishing pad 410 is rotated. Subsequently, the substrate 430 is brought into contact with the polishing pad 410 by lowering the carrier head 420. Accordingly, the surface of the substrate 430 is polished on the polishing pad 410. At this time, the slurry 538 is supplied onto the polishing pad 410. Therefore, the substrate 430 is polished mechanically by the abrasive component (particles) of the slurry 538 and the abrasive surface of polishing pad 410, and is polished chemically by the chemical component of the slurry 538. And, while the slurry 538 is being supplied onto the polishing pad 410, several streams of washing liquid are supplied through the feeding holes 510 of the washing device 500 and onto the surface of the polishing pad 410. The feeding holes 510 are spaced from one another by equal intervals and so, the water streams are also spaced from one another by the same intervals.

In the preferred embodiment, deionized water 515 is used as the washing liquid. The deionized water is fed into the chamber 507 of the washing device and is allowed to drain through the feed holes 510 in the plate 508. The deionized water 515 thus forms several streams that flow to the polishing pad vertically and freely to prevent the deionized water 515 from rebounding from the polishing pad 410. As a result, the deionized water 515 removes particles and slurry from the polishing pad 410. Preferably, the washing device 500 is positioned to supply deionized water 515 from a height of more than 20 mm, and more preferably, 20–40 mm, above the surface of the polishing pad 410.

Furthermore, the several streams of the deionized water 515 are allowed to continuously flow onto the polishing pad 410 for 1 to 5 seconds after the substrate has been polished to eliminate remaining slurry and polishing pollutants.

Figure 9:
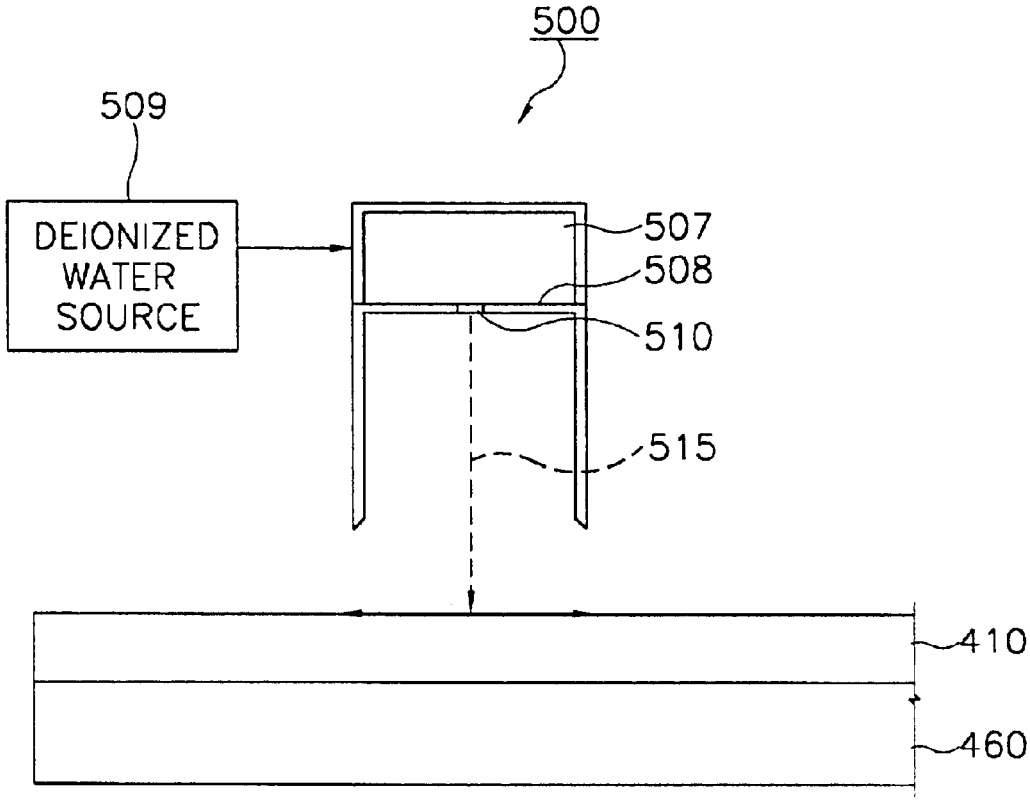
FIG. 9 is a schematic cross-sectional view of the washing device, illustrating the spraying of washing liquid according to the present invention.

FIG. 9 illustrates the flow of a stream of the deionized water 515 according to the present invention. The deionized water is fed from a deionized water source 509 into the chamber 507 of the washing device 500. From there, the deionized water 515 is allowed to drain through a feed hole(s) in the plate 508 so as to form a free flowing vertical stream. From FIG. 9 it is clear how such a stream of deionized water 515 by virtue of its verticality and free flow from a predetermined height can and will not rebound from the surface of the polishing pad 410. As a result, the amount of slurry that would otherwise fly up from the surface of the polishing pad 410 with the deionized water 515 is minimized which, in turn, prevents defects caused by the adherence of the slurry to components of the polishing apparatus.

In fact, more than 80% fewer particles remain inside the polishing apparatus and on the washing device when the present invention, in which the deionized water flows through the feeding holes 510 freely and vertically, is practiced compared to the case in which deionized water is forcibly sprayed through nozzles. This fact has been verified by actual measurements, the results of which are shown in Table 1 and Table 2. Table 1 shows the number of particles of various sizes remaining inside the polishing apparatus, and Table 2 shows the number of particles of various sizes remaining on washing devices whose nozzles and holes, respectively, are located 20 mm above the surface of the polishing pad.

TABLE 1

| | Spraying through nozzles | | Free flow through holes | |
|---|---|---|---|---|
| Size of the particles(μm) | First measurement | Second measurement | First measurement | Second measurement |
| 0.1 | 283,377 | 327,019 | 50,163 | 58,240 |
| 0.2 | 139,920 | 225,494 | 17,080 | 25,637 |
| 0.3 | 10,112 | 53,411 | 7,129 | 9,162 |
| 0.5 | 2,902 | 22,530 | 2,017 | 2,450 |
| 0.7 | 1,708 | 14,174 | 1,257 | 1,336 |
| 1.0 | 685 | 6,564 | 664 | 660 |

The particles inside the polishing apparatus were measured and counted for one minute with a laser particle counter. Referring to Table 1, the present invention allows 84% fewer particles to remain in comparison with the prior art in which the washing liquid is sprayed by nozzles onto the polishing pad.

TABLE 2

| | Spraying through nozzles | | Free flow through holes | |
|---|---|---|---|---|
| Size of the particles(μm) | First measurement | Second measurement | First measurement | Second measurement |
| 0.1 | 377,199 | 354,827 | 88,[001b]358 | 93,578 |
| 0.2 | 252,043 | 217,593 | 25,308 | 18,207 |
| 0.3 | 55,610 | 46,617 | 10,784 | 7,894 |
| 0.5 | 26,560 | 20,016 | 3,352 | 1,855 |
| 0.7 | 17,606 | 12,856 | 2,002 | 1,302 |
| 1.0 | 8,250 | 6,132 | 1,038 | 759 |

The particles on the washing devices were measured and counted for one minute with a laser particle counter. Referring to Table 2, the present invention allows 82% fewer particles to remain on the washing device in comparison with the prior art in which the washing liquid is sprayed by nozzles onto the polishing pad.

The improvements offered by the present invention in washing efficiency lead to increased uniformity in the polished surface of the substrate. An actual study has shown that when the washing device of the present invention is used during a polishing operation, the surface deviation of the polished substrate is about 173.5 Δ less than that which is present in a polished substrate when the conventional washing device having spray nozzles is used. In this study, the measured surface deviation of a substrate polished by an apparatus comprising a washing device having conventional spray nozzles was 652.6Δ, whereas the measured surface deviation was 479 Δ in the case of the present invention.

In summary then, according to the present invention, during the polishing process, the deionized water for removing the particles and slurry remaining on the polishing pad flows onto the polishing pad freely and vertically. Therefore, the amount of deionized water rebounding from the polishing pad is minimal and the amount of slurry flung with the deionized water off of the polishing pad is also minimal. The area at which any of the deionized water might rebound from the polishing pad is also minimal. Accordingly, polishing defects due to excess slurry can be minimized so that the reliability of semiconductor devices can be improved. And, the efficiency of the polishing process is improved due to the ability of the washing device to be readily detached from the apparatus for repair.

Finally, although the present invention has been described with respect to the preferred embodiment thereof, the present invention is not so limited. Rather, various changes and modifications can be made to the preferred embodiment within the true spirit and scope of the present invention as hereinafter claimed.

What is claimed is:

1. Apparatus for polishing a substrate, comprising:

a polishing station;

a polishing pad mounted to said polishing station; and a washing device disposed at one side of said polishing pad, said washing device having a plate defining at least one feed hole extending therethrough; and a source of washing solution connected to said washing device so as to supply washing solution to a location atop said plate, whereby the washing solution drains through said at least one feed hole to form at least one free-flowing vertical stream that impinges the upper surface of said polishing pad to thereby eliminate polishing-pollutants from the polishing pad.

2. The polishing apparatus as claimed in claim 1, and further comprising a carrier head having a vacuum chuck for grasping a substrate, said carrier head being disposed above said polishing station and being vertically movable so that a substrate grasped by the carrier head can be lowered into contact with the polishing pad.

3. The polishing apparatus as claimed in claim 2, and further comprising a first rotary member connected to the carrier head for making the carrier head rotate.

4. The polishing as claimed in claim 1, and further comprising a rotary member connected to said polishing pad for making the polishing pad rotate.

5. The polishing apparatus as claimed in claim 1, and further comprising a slurry dispenser that dispenses slurry onto the polishing pad.

6. The polishing apparatus as claimed in claim 5, wherein said slurry dispenser has an outlet located at a distal end of said washing device closest to the center of said polishing pad.

7. The polishing apparatus as claimed in claim 5, wherein said slurry dispenser includes a slurry outlet disposed at an outer peripheral portion of said polishing pad.

8. The polishing apparatus as claimed in claim 1, wherein said plate of the washing device has more than six of said feed holes extending therethrough, said feed holes being spaced at equal intervals from one another.

9. The polishing apparatus as claimed in claim 1, wherein each said at least one feed hole has a diameter of about 1.5 to 2.5 mm.

10. The polishing apparatus as claimed in claim 1, wherein said at least one feed hole is located at a height of about 20 to 40 mm above the upper surface of said polishing pad.

11. The polishing apparatus as claimed in claim 1, wherein said washing device is fixed to said polishing station by a screw.

12. The polishing apparatus as claimed in claim 1, wherein said washing device has a washing liquid outlet, connected to said source of washing solution, disposed at a distal end thereof closest to the center of said polishing pad.

13. The apparatus of polishing a substrate as claimed in claim 1, wherein said washing solution is deionized water.

* * * * *